US005301719A

United States Patent [19]

Bauerle

[11] Patent Number: 5,301,719

[45] Date of Patent: Apr. 12, 1994

[54] FLUOROELASTOMER LINED FLUE DUCTS

[75] Inventor: John G. Bauerle, Wilmington, Del.

[73] Assignee: E. I. Du Pont de Nemours and Company, Wilmington, Del.

[21] Appl. No.: 963,222

[22] Filed: Oct. 19, 1992

Related U.S. Application Data

[63] Continuation-in-part of Ser. No. 805,632, Dec. 12, 1991, abandoned.

[51] Int. Cl.[5] ..... B05D 5/00

[52] U.S. Cl. ..... 138/97; 138/98; 428/245

[58] Field of Search ..... 138/97; 428/246, 266, 428/421, 422, 423.7

[56] References Cited

U.S. PATENT DOCUMENTS

| | | | |
|---|---|---|---|
| 4,299,869 | 11/1981 | Casson et al. | 428/266 |
| 4,347,277 | 8/1982 | Slama et al. | 428/421 |
| 4,770,927 | 9/1988 | Effenberger et al. | 428/246 |
| 4,907,911 | 3/1990 | Rodriguez et al. | 138/97 |

*Primary Examiner*—Harvey C. Hornsby
*Assistant Examiner*—Patrick F. Brinson

[57] ABSTRACT

A flue duct liner comprising a substrate and a fluoroelastomer provides excellent protection against corrosive gases and easy installation.

8 Claims, 1 Drawing Sheet

FIGURE
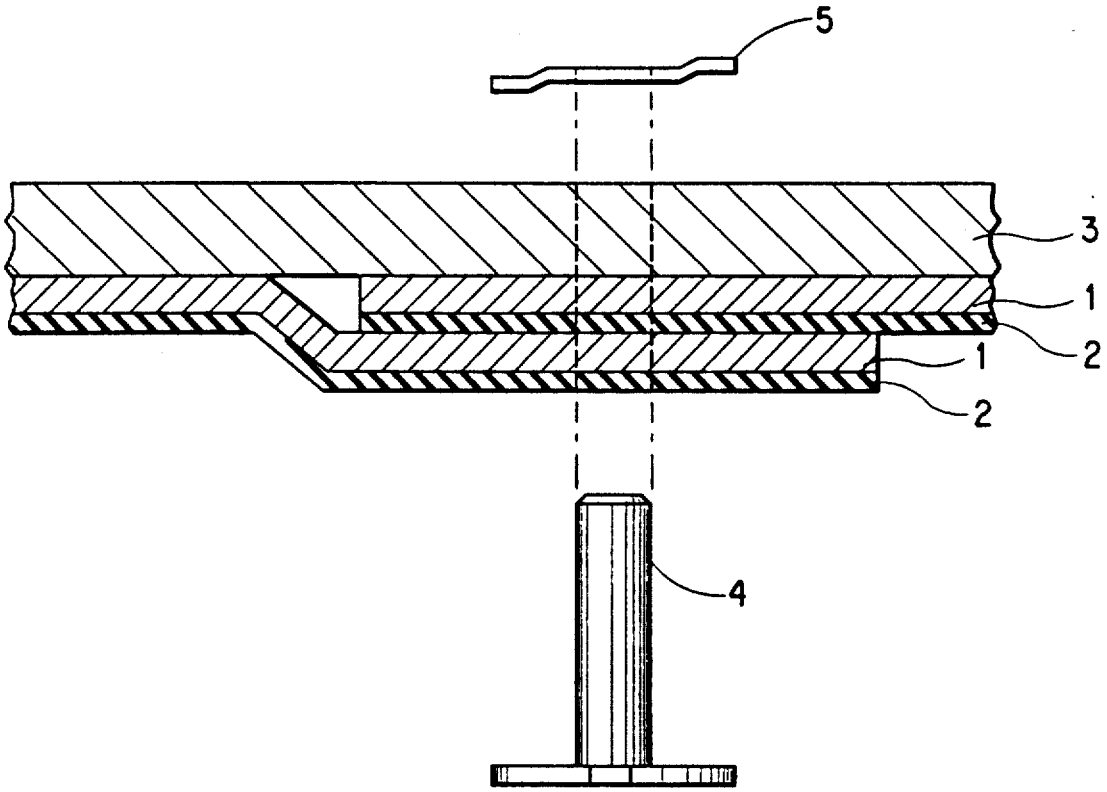

FLUOROELASTOMER LINED FLUE DUCTS

CROSS-REFERENCE TO RELATED APPLICATION

This is a continuation-in-part of copending application Ser. No. 07/805,632, filed Dec. 12, 1991, now abandoned.

BACKGROUND OF THE INVENTION

Flue gases, for example, from oil and coal-fired power generation facilities, typically contain corrosive components. The ductwork for carrying such gases in large power generation facilities can be 50 meters above ground level, so that repair and replacement is difficult and costly.

A wide variety of techniques have previously been proposed for the construction or protection of such flue ducts. For example, in low temperature applications, coatings such as vinyl esters or epoxies have been tested. Calendared rubber sheeting has also been considered for protection of the inner duct surfaces. However, this requires either an adhesive or a large number of mechanical fastenings to keep it in place, and has not provided a satisfactory means of protection.

Ducts have also been constructed of corrosion-resistant metals. Galvanized steel offers some protection against corrosive gases, while chromium-nickel alloys such as Hastalloy provide more effective protection. However, the high cost and difficulty in fabrication make such alloys an unattractive alternative. Still other protective measures that have been explored include the use of fluoroelastomer-based coatings. However, the solvents used in such coatings are difficult to handle, the coatings can only be applied in thin layers, and extensive preparation of the surface to be coated is generally necessary.

SUMMARY OF THE INVENTION

The present invention provides a flue duct lining that combines ease of installation and excellent protection against corrosive gases.

Specifically, the present invention provides a lined flue duct comprising (a) a flue duct and (b) a flue duct liner comprising a laminate of a metal substrate having a thickness of about from 0.5 to 4 mm and a sheet of cured, hydrogen-containing fluoroelastomer having a thickness of at least about 0.5 mm, the laminate being shaped to conform to the inner surface of the duct and attached thereto.

BRIEF DESCRIPTION OF THE DRAWING

The drawing is a cross-sectional illustration of a lined flue duct of the present invention.

DETAILED DESCRIPTION OF THE INVENTION

The substrate used in the present invention can be in the form of a solid sheet, with the fluoroelastomer bonded thereto, or in the form of a perforated sheet or screen. In the event that the substrate is in the form of a screen, the fluoroelastomer can be bonded to one surface or molded around the screen to at least partly encapsulate the screen. In this manner, both an adhesive and a mechanical bond of the fluoroelastomer to the substrate can be attained. Perforated substrates or screens offer a further advantage of weight reduction.

Metals which can be used for the substrate in the present invention include mild steel, galvanized steel, and aluminum. For structural integrity, the metal sheet should have a thickness of at least about 0.5 mm. In general, thicknesses greater than about 4 mm are difficult to form and handle. Substrates of about from 0.5 to 2 mm are preferred for ease of forming.

In the alternative, fiber-reinforced composite sheet materials can be used for the substrate. Representative matrix materials for such composites include epoxy, FEP, and polytetrafluoroethylene. Representative reinforcing fibers which can be used include carbon and glass. Such fiber-reinforced composite sheet materials for the substrate can result in significant weight savings.

A wide variety of fluoroelastomers can be used in the present invention, including those described in Honn et al., U.S. Pat. No. 3,318,854; Pailthorp et al., U.S. Pat. No. 2,968,649; Gladding et al., U.S. Pat. No. 3,707,529; Tatemoto, U.S. Pat. No. 4,243,770; Apotheker et al., U.S. Pat. No. 4,035,565 and Moore, U.S. Pat. No. 4,973,633, all of which are hereby incorporated by reference. In general, the acid resistance of the fluoroelastomer increases with the fluorine content of the polymer, and the more highly fluorinated fluoroelastomers are accordingly preferred. In addition, the acid resistance also varies with the curing system used. The specific combination of polymer and curing system selected will depend on a balance of performance characteristics and ease of manufacture. For example, a polyol curing system in combination with terpolymers of vinylidene fluoride, tetrafluoroethylene and hexafluoropropylene will provide a good balance of acid resistance and adhesion to a metal substrate.

The fluoropolymer used can be compounded and cured using the conventional techniques for such materials. Compounds of the fluoropolymer with curatives, filler, acid acceptors and process aids, as needed or desirable, can be mixed on standard rubber processing equipment, such as two-roll rubber mills or internal mixers. The compound is then typically formed into a continuous sheet, using a rubber calendar. The calendared sheet, or preform, can then be simultaneously bonded to the rigid substrate and cured, or vulcanized, under heat and pressure, as in a belt press. If a more flexible substrate is used, such as a thin steel sheet, conventional continuous vulcanizing processes can be used. Similarly, a belt press can be used in the production of either continuous lengths or panels of the laminates used in the present invention.

The vulcanization and bonding of the laminate layers can be carried our at a variety of pressures and temperatures, depending on the particular materials used. However, in general, a pressure of at least about 0.3 MPa and a temperature of at least about 160° C. for at least about 20 minutes is needed for satisfactory vulcanization and bonding.

The fluoroelastomer sheet should have a thickness of at least about 0.5 mm, and preferably at least about 1.0 mm. This minimum thickness is needed for adequate corrosion resistance. The maximum thickness will vary with the particular application, thicker sheets being more suitable for both large constructions and more corrosive environments.

The substrate and fluoroelastomer can be bonded together by one or more mechanical and adhesive techniques. For ease of operation, these two components are preferably bonded together in a flat configuration. Adhesives which can be used include those typically used in the bonding of elastomers to metal, such as silane-based and epoxy adhesive systems. Fluoroelastomer based cements can also be used, with appropriate primers, as will be evident to those skilled in the bonding of fluoroelastomers.

In a preferred embodiment of the present invention, the laminate further comprises a barrier layer to further protect the duct from the corrosive gases in operation. Such a layer, having a thickness, for example, of about from 0.1 to 0.5 mm, can be prepared from tetrafluoroethylene homopolymers and copolymers. Typical of comonomers which can be copolymerized with tetrafluoroethylene to provide the polymers used in barrier layers are perfluoroolefins containing 3-8 carbon atoms, and perfluoro (alkyvinyl ethers) containing 3-10 carbon atoms. Especially preferred comonomers are hexafluoropropylene, and perfluoro (propyvinyl ether). The barrier layer can be positioned either between the fluoroelastomer and the substrate or between the liner substrate and the duct. The barrier layer, when present, can be incorporated using the adhesive or mechanical bonding techniques described above.

After bonding the components together, the laminate is shaped into the desired configuration for lining of the duct. Typically, this is carried out prior to insertion into the duct. However, particularly with large installations, the laminate can be conformed to the shape of the inner duct surface during installation. The liners can be mechanically fastened to the interior of the ducts, using, for example, nuts and bolts, bolt/one-way spring fastener systems, or blind rivets. Generally, sheets of the laminate are overlapped in the course of installation. Caulking or gasketing can be used in the event that butt joints are used, or in combination with lapped surfaces, to further seal the joints.

The ductwork for which the present invention is applicable can, of course, vary widely, as will be evident to those skilled in the art. The duct shape can be curved or rectilinear, and the material is similarly not critical, and can include, for example, metal or masonry.

A lined flue duct of the present invention is illustrated in the drawing, in which a liner composed of substrate 1 and cured fluoroelastomer 2 is fastened to the interior of duct work 3, using a one-way spring fastener system made up of retainer bolt 4 and spring washer 5 at the point of overlapping of the liner.

The flue duct liners of the present invention markedly improve the life of the ductwork. The fluoroelastomers provide excellent resistance to the corrosive gases found in such ducts, and the shaped liners permit easy installation into flue ducts. In the context of the present invention, flue ducts are understood to include the exhaust ductwork per se as well as the chimneys associated with the ductwork.

The present invention is further illustrated by the following specific Examples, in which parts and percentages are by weight unless otherwise indicated.

EXAMPLE 1

A laminate was prepared from a sheet of mild steel having a thickness of 1.6 mm and an uncured sheet of fluoroelastomer terpolymer having a thickness of 1.5 mm. The steel plate was dip-coated with one coat of a primer solution of 20% Megum 3290-1 silane, commercially available form Chemetall GmbH, and 80% ethanol. The primed metal plate was then placed in a compression mold.

The fluoropolymer was a terpolymer of vinylidene fluoride, hexafluoropropylene, and tetrafluoroethylene, copolymerized in a monomer weight ratio of 45/30/25. 100 parts of the fluoropolymer were compounded with 30 parts of MT carbon black, 3 parts of magnesium oxide, 3 parts of calcium hydroxide, 1.4 parts of bisphenol AF, 0.65 parts of benzyltriphenyl phosphonium chloride and 1 part of carnauba wax, added as a processing aid. The compound was formed into a sheet on a two-roll rubber mill, and the resulting sheet of preform placed on top of the primed metal place in the compression mold.

The metal substrate and the sheet of fluoropolymer compound were then molded under a pressure of 1.9 MPa at 160° C. for 20 minutes. These conditions resulted in the simultaneous curing, or vulcanization, of the fluoropolymer compound and the bonding of the fluoroelastomer to the substrate.

The resulting laminate can be is shaped into the form of a flue duct and installed as a duct liner in a steel flue made and carrying corrosive gases, including oxides of sulfur and nitrogen as well as water due to an aqueous scrubbing system. Temperature in the duct would be up to 200° C., with short term excursions to 250° C. Normal service life of the duct is about 4 years before replacement. With the liner of the present invention, the duct will remain in serviceable condition for at least twice that period.

I claim:

1. A lined flue duct comprising (a) a flue duct and (b) a flue duct liner comprising a laminate of a metal substrate having a thickness of about from 0.5 to 4 mm and a sheet of cured, hydrogen-containing fluoroelastomer having a thickness of at least about 0.5 mm, the laminate being shaped to conform to the inner surface of the duct and mechanically attached thereto by means of detachable fastening means.

2. A lined flue duct of claim 1 wherein the metal substrate is perforated.

3. A lined flue duct of claim 1 wherein the fluoroelastomer is a copolymer of vinylidene fluoride and hexafluoropropylene.

4. A lined flue duct of claim 3 wherein the copolymer further comprises tetrafluoroethylene.

5. A lined flue duct of claim 3 wherein the fluoroelastomer consists essentially of a copolymer of tetrafluoroethylene and propylene.

6. A lined flue duct of claim 1 further comprising a barrier layer.

7. A lined flue duct of claim 6 wherein a barrier layer consists essentially of at least one polymer selected from tetrafluoroethylene homopolymers and copolymers.

8. A lined flue duct of claim 1 wherein the substrate has a thickness of about from 0.5 to 1.0 mm.

* * * * *